US005615555A

United States Patent [19]

Mina

[11] Patent Number: 5,615,555

[45] Date of Patent: Apr. 1, 1997

[54] DUAL FUEL INJECTOR WITH PURGE AND PREMIX

[75] Inventor: Theodors I. Mina, Lincoln, United Kingdom

[73] Assignee: European Gas Turbines Limited, United Kingdom

[21] Appl. No.: 432,136

[22] PCT Filed: Oct. 12, 1994

[86] PCT No.: PCT/GB94/02219

§ 371 Date: May 9, 1995

§ 102(e) Date: May 9, 1995

[87] PCT Pub. No.: WO95/11408

PCT Pub. Date: Apr. 27, 1995

[30] Foreign Application Priority Data

Oct. 19, 1993 [GB] United Kingdom ..... 9321505

[51] Int. Cl.[6] ..... F02C 1/00

[52] U.S. Cl. ..... 60/742; 60/737; 60/748

[58] Field of Search ..... 60/39.094, 39.463, 60/737, 742, 748

[56] References Cited

U.S. PATENT DOCUMENTS

| | | | |
|---|---|---|---|
| 3,684,186 | 8/1972 | Helmrich | 60/742 |
| 3,763,650 | 10/1973 | Hussey et al. | 60/39.463 |
| 3,937,011 | 2/1976 | Caruel et al. | 60/742 |
| 4,327,547 | 5/1982 | Hughes et al. | 60/742 |
| 4,337,618 | 7/1982 | Hughes et al. | 60/39.55 |
| 4,342,198 | 8/1982 | Willis | 60/748 |
| 4,418,543 | 12/1983 | Faucher et al. | 60/742 |
| 4,713,938 | 12/1987 | Willis | 60/742 |
| 4,726,192 | 2/1988 | Willis et al. | 60/748 |
| 5,228,283 | 7/1993 | Sciocchetti | 60/737 |
| 5,423,173 | 6/1995 | Lemon et al. | 60/742 |

FOREIGN PATENT DOCUMENTS

| | | |
|---|---|---|
| 2035540 | 6/1980 | United Kingdom . |
| 2122333 | 1/1984 | United Kingdom . |
| 2175993 | 12/1986 | United Kingdom . |
| 2232479 | 12/1990 | United Kingdom . |

*Primary Examiner*—Louis J. Casaregola
*Assistant Examiner*—Ted Kim
*Attorney, Agent, or Firm*—Kirschstein et al.

[57] ABSTRACT

A fuel injector for a gas turbine conbustor, the injector operating on gas and liquid fuels selectively. The injector has a central liquid fuel duct and jets, an annular gas duct and gas jets, and an outer annular combustion air duct. Operation on the liquid fuel tends to cause combustion products to be ingested into the gas orifices so impeding efficient gas combustion. The invention provides apertures (17) between the outer air duct and the intermediate gas duct whereby during operation on liquid fuel air bleeds into the gas duct and purges the gas orifices. As an added advantage, in a transition from liquid fuel to gas, the gas pressure is increased to a point where the air bleed is reversed and gas bleeds into the air duct. The pre-mixed gas/air is then emitted from swirlers surrounding the ring of gas jets. More efficient gas combustion results.

5 Claims, 1 Drawing Sheet

DUAL FUEL INJECTOR WITH PURGE AND PREMIX

BACKGROUND OF THE INVENTION

This application is a 371 of PCT/GB94/02219 filed Oct. 12, 1994.

This invention relates to gas turbine engines which operate on gas and at least one alternative fuel. A typical application is to a dual fuel gas turbine operating on gas as the primary or main fuel and liquid as the secondary or stand-by fuel.

During the operation of a dual fuel gas turbine on the stand-by fuel, liquid for example, the gas fuel injector passages are open to the hot combustion products of the primary zone. Hence re-circulation of the hot gases within the gas injector passages is inevitable. This problem is exaggerated if the gas passages in question are designed for low calorific value (LBTU) gas fuel and are therefore larger than those designed for natural gas operation.

The ingestion of combustion products may cause damage or blockage of the gas passages. Previous work addressed this problem by purging the gas passages when operating on the stand-by fuel by the use of external pressurised steam or other gases. This method although effective, necessitates the addition of expensive equipment to generate and or supply the purge medium therefore increasing both capital and operating costs.

While the use of compressor air for this purging process has been proposed previously, difficulties involving fuel spilling back (i.e. upstream of the injector nozzle) and flashback have not previously been overcome.

SUMMARY OF THE INVENTION

An object of the present invention is to alleviate the above difficulties while benefitting the control of smoke emissions.

According to the present invention, a fuel injector for a combustor of a turbine engine operable on either or both of primary and secondary fluid fuels, in which primary fuel orifices are exposed to combustion products during operation on the secondary fuel, comprises secondary fuel orifices connected to a secondary fuel supply passage, a ring of primary fuel orifices connected to an annular primary fuel manifold, and an annular air passage providing combustion air for fuel injected by the primary and secondary fuel orifices, the air passage being formed between a wall of the manifold and a shroud member and having an inlet for combustion air between an inlet end of the shroud member and the wall of the manifold, the injector further comprising a multiplicity of holes in the manifold wall between the air passage and the manifold, the holes and the air passage dimensions being such that the primary orifices are purged by the emission of air during operation on secondary fuel and, during operation on primary fuel, at low fuel pressure air bleeds through the holes and at high fuel pressure primary fuel bleeds through the holes to provide in both cases a pre-mix of primary fuel and air.

The primary fuel manifold may comprise an intermediate wall dividing the downstream end of the manifold into concentric annular regions, the primary fuel orifices opening into the inner one of these regions and the outer one of these regions comprising turbulence inducing means.

The air passage may be open to a combustion region downstream of the injector by way of turbulence inducing means.

The fuel injector may comprise a cylindrical fuel orifice head with a planar downstream face having an array of secondary fuel orifices surrounded by a ring of primary fuel orifices the secondary fuel orifices having access to an axial secondary fuel duct and the primary fuel orifices having access to an annular primary fuel passage, the shroud member comprising a substantially cylindrical portion and an annular portion having an aperture providing access to a combustion region downstream of the injector, the annular portion being spaced from the downstream face to provide a path for purging air in operation on secondary fuel and for pre-mix combustion air in operation on primary fuel.

BRIEF DESCRIPTION OF THE DRAWINGS

Two embodiments of fuel injector in accordance with the invention will now be described, by way of example, with reference to the accompanying drawings in which.

DETAILED DESCRIPTION OF THE PREFERRED EMBODIMENTS

The injector is mounted in a combustion chamber (not shown) and may be one of a number of similar injectors mounted in an annular arrangement facing downstream. Upstream of the injectors is a source of combustion air, i.e. an air compressor of the gas turbine engine incorporating the combustor. Compressed air is driven past (and as will be seen, through) the injectors basically to permit combustion in the 'primary zone' 2 downstream of the injectors.

Figure 1:
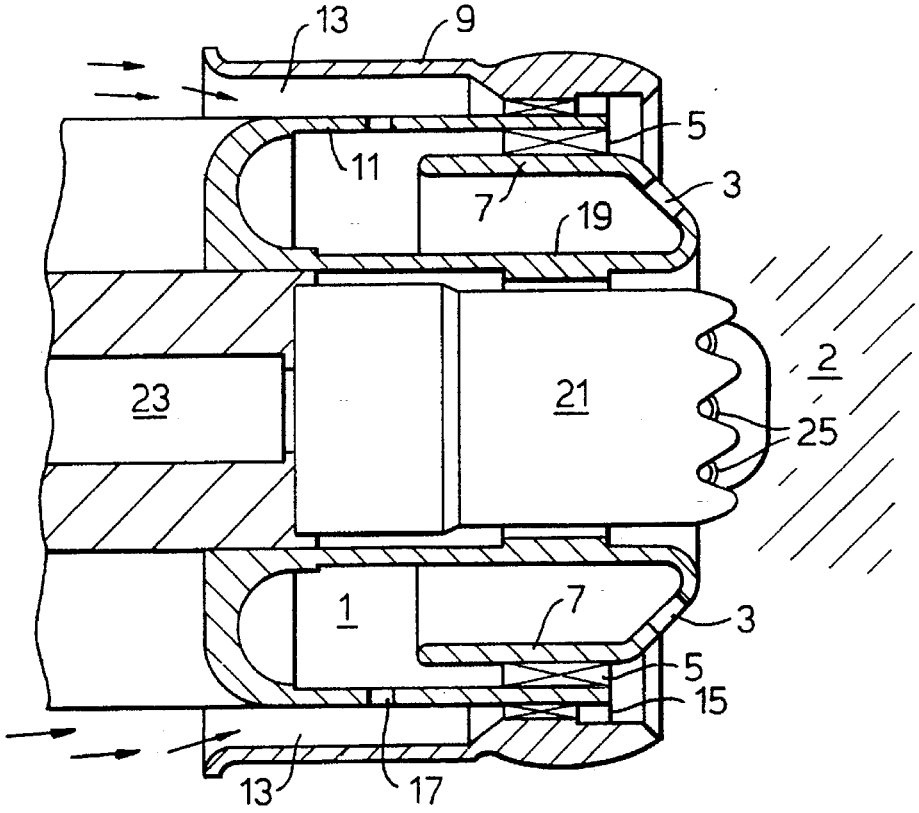
FIG. 1 is an axial section of an LBTU dual fuel injector.

Referring to FIG. 1, the primary fuel, gas is fed to an annular gas passage or manifold 1 which feeds a ring of gas orifices 3. The gas passage 1 also feeds an annular array of guide vanes which act as 'swirlers' 5 to give a rotational deflection and a degree of turbulence to the emergent fuel or fuel-air mixture about the injector axis. The swirled gas component is separated from that through the orifices 3 by an intermediate wall 7.

Surrounding the gas passage is a shroud 9 which is open to the upstream end to gather in compressor air and pass it out at the downstream end to mix with fuel from the adjacent orifices 3 and the swirlers 5. The downstream end of the shrouded air passage 13 is fitted with further axial swirlers 15 to improve the mixing of the gas fuel and compressor air.

The outer wall 11 of the gas passage 1 has a number of radial holes 17 around its circumference at an axial position just upstream of the upstream end of the intermediate wall 7 of the gas passage 1. Compressor air can therefore enter the gas passage by way of the purging holes 17 in the absence of gas fuel and emerge from the gas orifices 3.

Within the inner wall 19 of the gas passage 1 is a secondary fuel nozzle 21 which typically operates with liquid fuel. This is supplied by an axial duct 23 and is injected into the combustion chamber from orifices 25. In operation on liquid fuel, combustion products close to the injector would tend to circulate and enter the gas orifices 3. Solids would be deposited and the efficiency of the combustor reduced: Overcoming this disadvantage is one of the aims of the invention.

When operating on gas fuel the gas fuel pressure is increased from zero and the flow or bleeding of air from the air passage 13 through the apertures 17 is consequently reduced as the opposing fuel pressure increases. Above this 'pressure balance' condition the increased gas pressure reverses the flow direction to cause gas bleeding through the apertures 17 to spill into the air passage 13. Such spillage is however, prevented from spreading into the air stream upstream of the apertures by the shroud 9 which confines the spillage to the fast flowing air stream close to the injector wall 11. The spilled fuel and air is further mixed by the swirlers 15 on emerging into the combustion zone. Spillage of the gas fuel is therefore prevented from moving upstream and causing ignition flashback which might otherwise occur, in addition to providing a pre-mix of fuel and air.

In addition to the above purge and spillage/flashback considerations the provision of purging air during operation on the secondary (liquid) fuel resets the primary zone (2) stoichiometry advantageously. A leaner mixture is produced which is beneficial to smoke emissions control. Furthermore, on fuel change to LBTU gas fuel, which, as explained above, eliminates the purge air flow, the primary zone stoichiometry becomes relatively richer, which is beneficial to low power carbon monoxide emission control.

An injector of the form described can also be used to reduce the NOx emissions of the combustion process by increasing the aperture (17) size to allow a larger portion of the gas fuel to exit through the aperture to the air passage 13 and swirlers 15. This portion will be partially mixed with swirler air and this will have the same effect as reducing the calorific value of the gas fuel and result in a reduction in NOx emissions.

The advantage of using this method for NOx control over premixed systems with pilot fuelling for starting and flame stabilization is the simplicity of both fuel and control system as only one gas fuel manifold and one gas flow control are required.

At starting and low load the gas flow will occur from the original gas holes 3 and as, in these conditions, the pressure is low in the gas passages it will only be capable of overcoming the combustion chamber (primary zone 2) pressure which is lower than the compressor delivery pressure in the air passages 13. At a given-operating load condition the required gas flow will necessitate an increase in gas pressure above the air pressure in the air passages 13 therefore allowing gas to exit from the purge aperture 17 mixed with the air. The operating point at which this is achieved can be set by the design parameters of the apertures, the air passages and the combustor pressure drop. The operating range over which this process occurs can be chosen to cover starting conditions only or any intermediate range up to the full speed no load ('FSNL') point.

Figure 2:
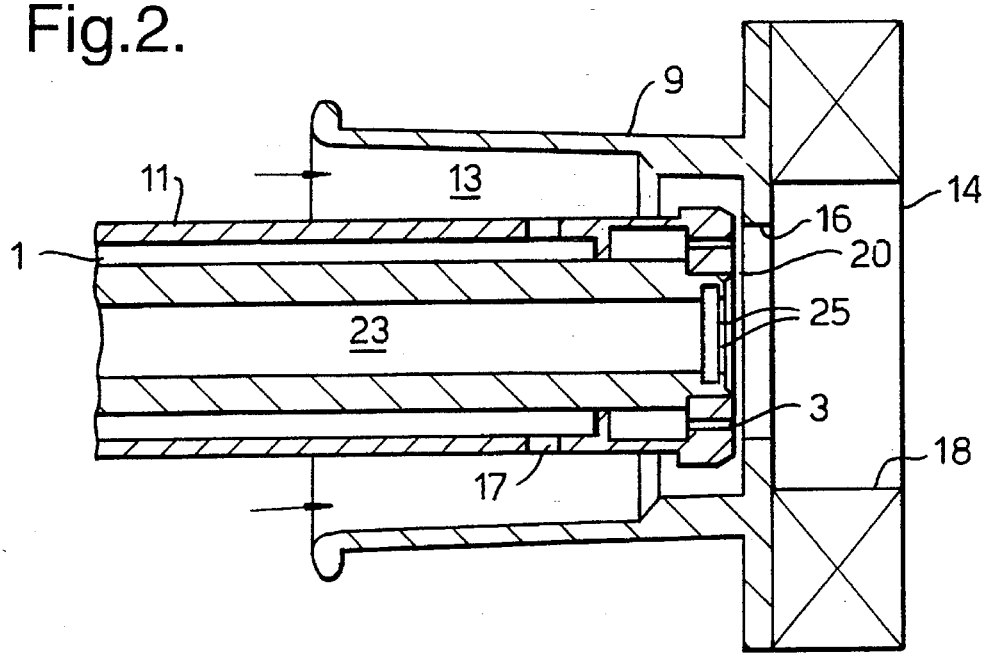
FIG. 2 is an axial section of a natural gas dual fuel injector.

FIG. 2 shows a fuel injector suitable for natural gas fuel as opposed to the LBTU gas of FIG. 1. The form of the injector is different but the basic elements of the FIG. 1 design are present. Thus a shroud 9 surrounds an annular gas passage 1 the outer wall 11 of which has a ring of purge apertures 17. The gas passage 1 terminates in a flat head with a ring of gas orifices 3. The shroud 9 is combined with a swirler head 14 which has a central aperture 16 providing access for the gas jets to the combustion chamber. Radial swirlers 18 are mounted on the swirler head to provide lateral dispersion and mixing of fuel and air.

The liquid fuel is supplied along an axial bore 23 to liquid fuel orifices 25 as before. Again it is important that while operating on liquid fuel the gas orifices 3 do not become fouled, i.e. coated with combustion products. This is achieved by arranging that the swirler head 14 is spaced from the fuel orifice head by a small gap referred to as the anti-carbon gap (20).

During operation on the secondary liquid fuel, air is entrained in the air passage 13, passes through the apertures 17 into the gas passage 1 and exits from the gas orifices 3 thus preventing the ingress of combustion products. Air also passes through the air passage 13 outside the gas passage and through the anti-carbon gap 20.

It may be seen that the principles of operation are the same as for the FIG. 1 embodiment. Spillage and flashback during operation on the primary fuel are inhibited by the constrained air flow through the air passage 13. Fouling of the gas orifices during secondary fuel operation is prevented by purging air passing through the purge apertures 17 and through the gas orifices 3.

I claim:

1. A fuel injector for a turbine-engine combustor, the injector comprising, working radially outwards from an axis:

a) a secondary-fuel supply passage connected to a plurality of secondary-fuel outlet orifices, said secondary-fuel outlet orifices opening into a combustion region downstream of the injector;

b) an annular primary-fuel manifold connected to a ring of primary-fuel outlet orifices, said primary-fuel outlet orifices opening into said combustion region;

c) an annular air passage for providing combustion air for fuel injected by said primary- and secondary-fuel orifices, said air passage being formed between a wall of said primary-fuel manifold and an outer shroud member, said air passage having an inlet for combustion air between an inlet end of said shroud member and said primary-fuel manifold wall and an outlet opening into said combustion region;

d) purge and premix means, including:

i) a multiplicity of holes in said manifold wall between said air passage and said manifold, said holes allowing air to pass into said manifold for the purging of said primary-fuel outlet orifices during operation on secondary fuel and, during operation on primary fuel, allowing bleeding of a working fluid of either of said air passage and said manifold into the other of said air passage and said manifold in dependence on primary-fuel pressure, thereby in either case to provide a pre-mix of primary fuel and air, and ii) means for determining a point during said operation on primary fuel at which bleeding of one of said working fluids gives way to a bleeding of the other of said working fluids.

2. The fuel injector according to claim 1, wherein said determining means is constituted by at least said holes and said air passage being of dimensions calculated in dependence on expected values of pressure of air inside said air passage and of primary fuel inside said primary-fuel manifold for a given load condition, thereby to effect a transition of said bleeding of one of said working fluids to said bleeding of the other of said working fluids at an appearance of said load condition.

3. The fuel injector according to claim 1, wherein said primary-fuel manifold includes an intermediate wall dividing a downstream end of said manifold into inner and outer concentric annular regions, said primary-fuel outlet orifices opening into said inner annular region and said outer annular region further including turbulence-inducing means.

4. The fuel injector according to claim 1, wherein said outlet means of said air passage includes turbulence-inducing means.

5. The fuel injector according to claim 1 adapted for use with a low calorific value primary gas fuel, thereby excluding the use of natural gas, and a liquid secondary fuel.

* * * * *